US006536654B2

(12) United States Patent
Reynolds et al.

(10) Patent No.: US 6,536,654 B2
(45) Date of Patent: Mar. 25, 2003

(54) BOTTLE PACKAGES

(75) Inventors: Isaac Reynolds, Cincinnati, OH (US); Andrew M. Parrella, Cincinnati, OH (US); Raymond A. Kowalski, Los Angeles, CA (US)

(73) Assignee: EM Industries, Inc., Hawthorn, NY (US)

( * ) Notice: Subject to any disclaimer, the term of this patent is extended or adjusted under 35 U.S.C. 154(b) by 0 days.

(21) Appl. No.: 09/793,727

(22) Filed: Feb. 27, 2001

(65) Prior Publication Data

US 2002/0117540 A1 Aug. 29, 2002

(51) Int. Cl.[7] ..... B65D 3/00

(52) U.S. Cl. ..... 229/103.11; 206/593; 206/594; 229/120.23; 229/120.24; 229/120.26; 229/120.29; 229/120.35; 229/120.38; 229/122.32

(58) Field of Search ..... 229/103.11, 120.23, 229/120.24, 120.26, 120.29, 120.35, 120.38, 122.32, 122.33; 206/427, 433, 586, 591, 593, 594

(56) References Cited

U.S. PATENT DOCUMENTS 1,917,886 A * 7/1933 Hogan ..... 229/122.32
3,044,679 A * 7/1962 Wheeler et al. ..... 229/120.31
3,866,523 A * 2/1975 Geschwender ..... 493/18
4,504,497 A * 3/1985 Kurth et al. ..... 229/122.32
4,706,809 A * 11/1987 Halsell ..... 229/122.32
5,000,372 A * 3/1991 Hollander et al. ..... 229/103.11
5,040,696 A * 8/1991 Liebel ..... 229/122.32
5,190,212 A * 3/1993 Morris ..... 229/120.29
5,429,264 A * 7/1995 Hollander et al. ..... 229/103.11
5,462,171 A * 10/1995 Moog et al. ..... 206/594
5,540,972 A * 7/1996 Jaegers et al. ..... 493/966
6,056,121 A * 5/2000 Olson ..... 206/577

* cited by examiner

*Primary Examiner*—Gary E. Elkins
(74) *Attorney, Agent, or Firm*—Millen, White, Zelano & Branigan, P.C.

(57) ABSTRACT

A package for at least one bottle comprises a carton, a honeycomb core within the carton for surrounding the bottle, as well as bottom and top honeycomb pads abutting the honeycomb core. The honeycomb core is severed from its outer skin through the honeycomb material to its inner skin so that it may be folded to form an enclosure about the bottle. The bottle has the same height as the honeycomb core and when covered at its ends by the honeycomb pads positioned beneath and on top of the honeycomb core provides an assembly which completely fills the carton. In one embodiment of the invention, four bottles are contained within a square carton and are held in place by two G-shaped honeycomb core portions which cooperate to form four compartments for holding the bottles. In another embodiment, six bottles are packaged in a rectangular carton with the honeycomb core substantially formed by a continuous honeycomb panel severed to allow folding into six compartments.

15 Claims, 7 Drawing Sheets

BOTTLE PACKAGES

FIELD OF THE INVENTION

The present invention relates to bottle packages. More particularly, the present invention relates to bottle packages which utilize honeycomb packing to cushion bottles within packages.

BACKGROUND OF THE INVENTION

Liquid products which may for one reason or another are not storable or shipable in plastic containers are stored and shipped in glass containers. For example, chemical products such as solutions which must retain a high level of purity, for example solutions used in chromatography columns, are shipped in glass bottles because there may be an adverse reaction with the plastic used to make plastic containers. Glass bottles are of course brittle and shatter on impact. Therefore it is necessary to cushion glass bottles containing chemical products to prevent breakage during shipping and storage. This is necessary not only to protect the product itself but also because these products are frequently solvents which present a hazard if allowed to spill into the surrounding environment.

Disposing of packaging material is an additional burden on those who receive bottles and who are already burdened with disposing not only the chemical products as, or after, they are used, but also with the burden of disposing of the bottles themselves. Any arrangement which can reduce the disposal burden on a user of chemical products shipped and stored in bottles is of substantial importance. Currently, it is almost a universal practice to package bottles of chemicals in expanded foam, polystyrene (EPS) packing which is placed around the bottles in a corrugated paper board container. A drawback of using EPS is that solvents in or on the bottles can dissolve the EPS, thus reducing or eliminating its cushioning purpose. Moreover, once the package is opened there are two streams of material which must be disposed of i.e. one for corrugated paper board and the other for expanded polystyrene. Polystyrene foam is now becoming an environmental hazard in of itself, both because the gases that it releases as it decomposes and because of its exaggerated physical presence due to its rigid expanded foam structure that consumes a great deal of space.

In view of these considerations, there is a need for an economical replacement of polystyrene with a packing material which elevates the burden of having two waste streams and which uses a packing material for which there are waste disposal facilities and arrangements already in place.

SUMMARY OF THE INVENTION

In view of the aforementioned considerations, the present invention is directed to packaging for at least one glass bottle comprising a carton, a paper board honeycomb core and top and bottom pads of honeycomb material. The carton is made of paper board panels defining a space having a rectangular cross-section and a preselected axial length which panels are joined to define four interior comers. The paper board honeycomb core has top and bottom ends disposed in the first space and extend axially with respect to the axial length of the panels while being in abutment with the panels. The honeycomb core also has at least one facing sheet facing inwardly with respect to the packaging and defining a second space for receiving the bottle. Axially extending voids free of honeycomb material are formed in the honeycomb core to allow the core to be formed about the bottle. Rectangular panels of honeycomb material are positioned in the carton above and below the bottle and in abutment with the top and bottom ends of the honeycomb core.

In accordance with additional aspects of the invention, the honeycomb core has either four axially extending voids which align with the four interior comers of a square carton or eight axially extending voids which divide the honeycomb core into eight panels so that the honeycomb core can be folded to form a honeycomb tube within a square carton.

In still a further embodiment of the invention, there are four bottles in a square carton and the honeycomb core is comprised of two portions, each defining a pair of compartments which receive one bottle. In a further aspect of this arrangement, each portion of the honeycomb core is G-shaped so that when disposed adjacent one another within the carton four closed compartments result.

In another embodiment of the invention there are six bottles in a rectangular carton with a honeycomb core which is severed and bent a plurality of times to define eight compartments, each receiving one glass bottle.

DETAILED DESCRIPTION

Figure 1A:
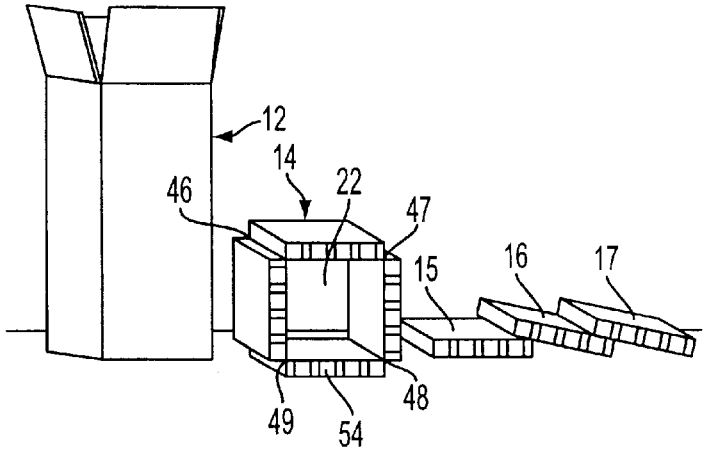
FIG. 1A is a perspective view of a packaging kit in accordance with a first embodiment of the present invention.

Referring now to FIGS. 1–4 where a first embodiment of the invention is illustrated, it is seen that a packaging kit 10 is comprised of a paper board carton 12 defining a first space 13, a honeycomb insert 14 and three honeycomb pads 15, 16 and 17. The carton 12 is slightly elongated to accommodate a round, one liter bottle of a selected outside diameter D in the first space 13.

Figure 3:
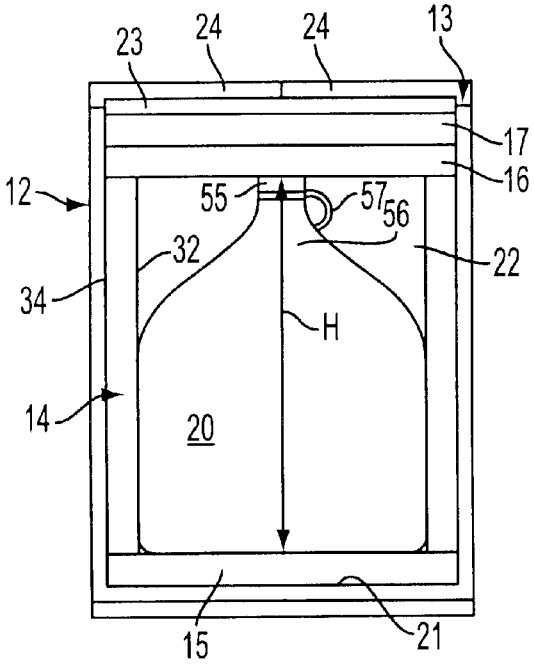
FIG. 3 is a side elevation of the package of FIG. 2.

The kit 10 is assembled by placing the honeycomb pad 15 on the bottom 21 of the carton, then inserting the honeycomb core 14 into the carton to rest on the bottom pad 15 to form a second space 22 for receiving the bottle 20. As is seen in FIG. 3, the top honeycomb pads 16 and 17 are then placed on top of the honeycomb core 14 over the bottle 20. The carton 12 has inner and outer sets of opposed flaps 23 and 24 respectively which fold over the top pad 17 so as to close the top of the carton 12. Sealing tape is then placed across the seam between edges 25 of the top flaps 24.

Figure 1B:
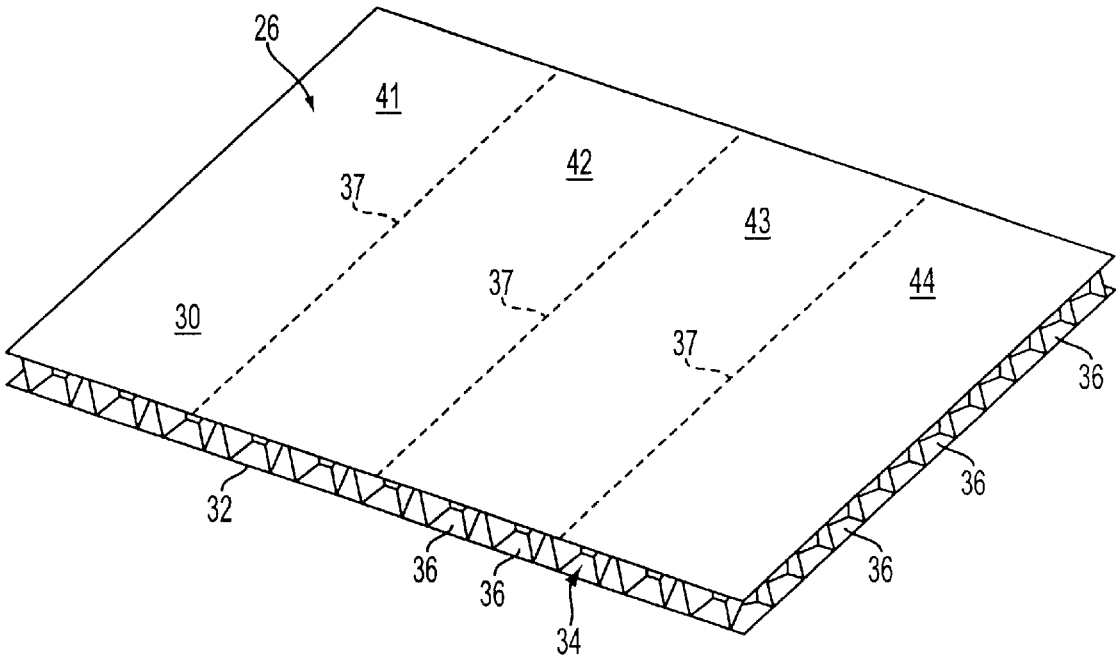
FIG. 1B is a planar view of a panel of honeycomb material which is severed and folded to provide honeycomb packing for the packaging kit of FIG. 1.
Figure 2:
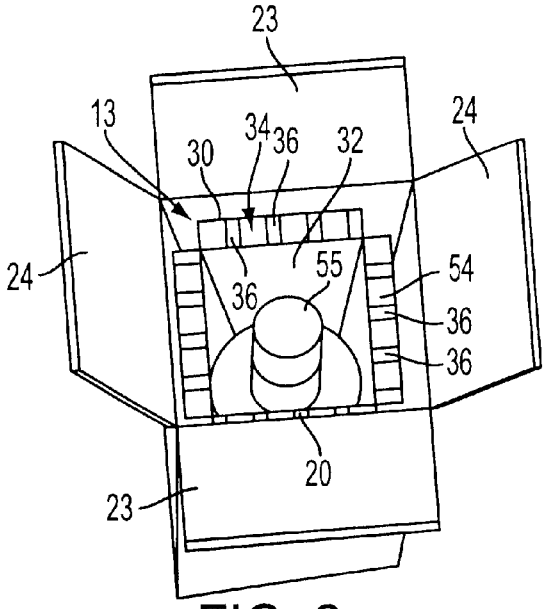
FIG. 2 is a top perspective view of the kit of FIG. 1 assembled with a bottle therein.

In order to facilitate the packaging concept of FIGS. 1–4, the core 14 is configured from a rectangular panel 26 (FIG. 1B of honeycomb material such as that available from the Hexacomb Corporation of Lincolnshire, Ill., wherein the honeycomb panel 26 has an outer sheet 30 and an inner sheet 32 between which is sandwiched a honeycomb material 34 comprised of cells 36.

Such a panel is disclosed in U.S. Pat. No. 5,540,972 issued Jul. 30, 1996 to Hexacomb Corporation, incorporated herein by reference. The honeycomb material 34 is preferably comprised of six-sided or hexagonal cells which provide a rigid structure when bonded to the sheets 30 and 32.

As is seen in FIG. 1A, the rectangular panel 26 is severed across its width by three cuts 37, which cuts extend through the outer sheet 30 and honeycomb material 34 made of the cells 36 to the inner facing sheet 32 so as to divide the honeycomb panel 26 into four panels 41, 42, 43 and 44. These panels have equal widths so that when folded at the inner sheet 32, the honeycomb core 14 is formed having voids 46, 47, 48 and 49 opening outwardly at the corners thereof.

Figure 4:
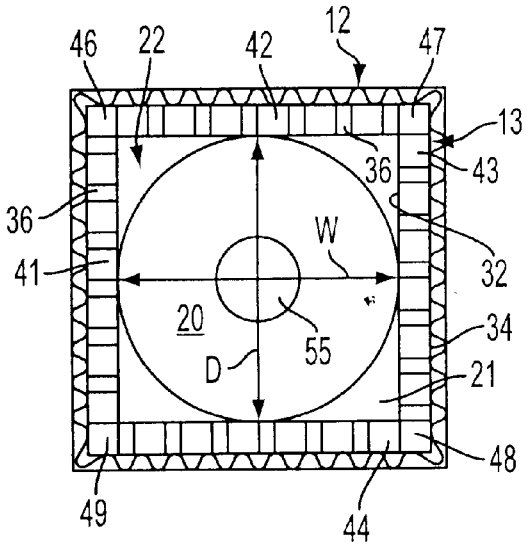
FIG. 4 is a top view of the package of FIGS. 2 and 3.

As is best seen in FIG. 4, the square opening 22 within the core 14 has a width substantially equal to the diameter D of the bottle 20 while the width of each panel plus the thickness of two panels is equal to the width W of the first square space 13 of carton 12. Consequently, the bottle 20 is laterally restrained within the carton 12 by the honeycomb core 14, while at the same time being protected by the rigid honeycomb structure provided by the honeycomb material 34 which must be crushed before the bottle 20 can break due to lateral impact.

As is seen in FIG. 3, the bottle 20 has a height H which is equal to the width of the panel 26 and thus the height of the honeycomb core 14 made of the panel 26. Since the bottom honeycomb pad 15 is a square which matches the cross-sectional area of the opening 13, it provides a rigid base which supports the bottom of the bottle 20 while cushioning the bottom with honeycomb material 34. The honeycomb core 14 rests on top of the bottom pad 15 and remains oriented in square alignment therewith because of the square paper board carton 12. The top honeycomb pads 16 and 17 rest on the upper end 54 of the honeycomb core 14 as well as on the top surface of the cap 55 of bottle 20.

Since the neck portion 56 of the bottle is more vulnerable to breakage due to vertical impacts, two square top honeycomb pads 16 and 17 are used. Again, since the pads 15, 16 and 17 correspond to the cross-sectional area of the opening 13 of the carton 12, and since the width of the honeycomb core 14 also corresponds to the cross-sectional area 13, a very rigid cushion is provided for the bottle 20, which cushion is enhanced by closing the inner and outer flaps 23 and 24, respectively, against the top pad 17 and sealing the top flaps 24 with tape.

Figure 5:
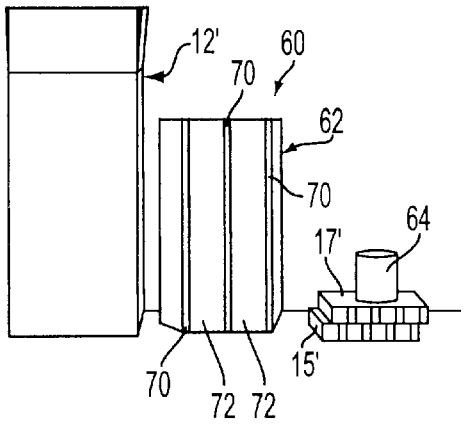
FIG. 5 is a side perspective view of a second embodiment of a packaging kit according to the present invention.
Figure 6:
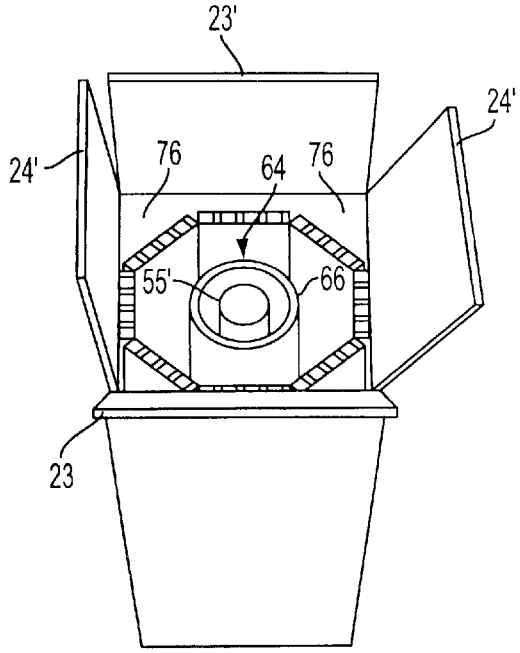
FIG. 6 is a top perspective view of a package comprising the components of FIG. 5 with a bottle therein.
Figure 7:
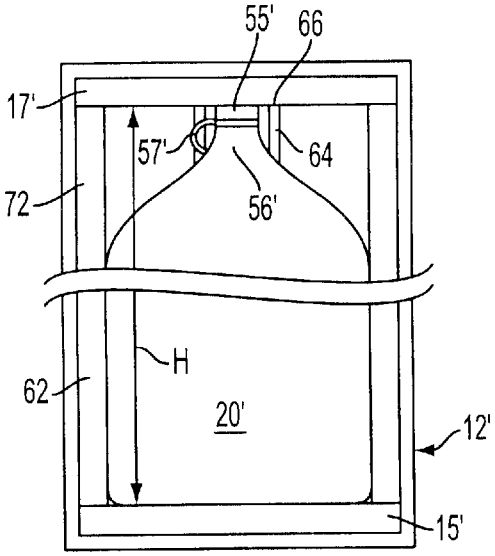
FIG. 7 is a side elevation of the package of FIG. 6.

Referring now to FIGS. 5–8 where a second embodiment of the invention is disclosed for packaging 1 liter bottles 20' for containing chemicals wherein like the first embodiment, a package 59 is assembled from a kit 60. A similar but larger carton 12' contains a different honeycomb core 62. Moreover, there is a single bottom honeycomb pad 15' and a single top honeycomb pad 17' instead of two top honeycomb pads, as is the case in FIG. 1. In the embodiment of FIGS. 5–7, the kit 60 includes a rigid paper board collar 64 which fits around the neck portion 56' of the bottle 20'. The paper board collar 64 has an upper surface 66 which is coplanar with the top surface of the cap 55' on the bottle 20' and with a top end 68 of the honeycomb core 62. The top honeycomb pad 17' takes up the remaining vertical space in the carton 12' so that when the inner and outer flaps 23' and 24' of the carton are folded over, they rests against the top honeycomb pad 17'. The paper board collar 64 has an axially extending slot 65 therein which accommodates a loop type handle 57' which extends from the neck 56' of the bottle 20'.

As with the honeycomb core 14 of FIGS. 1–4, the honeycomb core 62 has a face-to-face inner width which corresponds to the diameter D' of the bottle 20', and also as is seen in FIG. 7, has a height or axial length H' equal to that of the bottle 20'.

Figure 8:
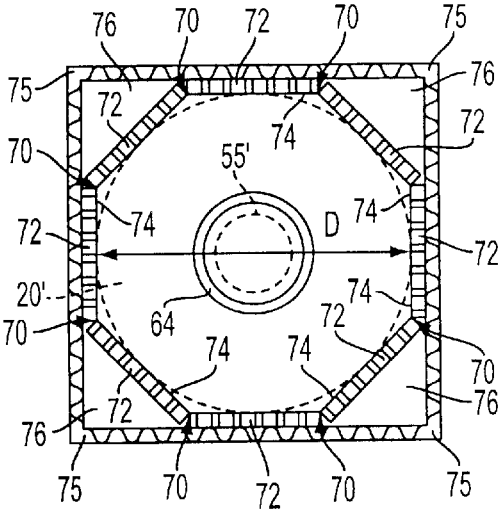
FIG. 8 is a top view of the package of FIG. 6.

As is seen in FIG. 8, the honeycomb core 62 has seven voids 70 and eight panels 72. The eight panels 72 engage the bottle 20' (shown in dotted lines) at eight locations 74 around its perimeter and thus support the bottle 20' laterally at twice as many locations as the bottle 20 is supported by the honeycomb core 14 of FIGS. 1–4. In addition, the panels 72 extend diagonally with respect to comers 75 of the carton 12' while allowing the comers to provide crush zones 76 to help absorb comer impacts. Like the honeycomb core 14 of FIG. 1A the honeycomb core 62 is formed of a single honeycomb panel 77 which has been severed this time to form eight panels 70 instead of four panels.

While the illustrated tube formed by the honeycomb core 62 has eight panel sections 72, the tube may have more than eight panels or may have six panels so that the honeycomb tube has panels which abut, but do not all have surfaces which extend parallel with the side panels of the carton 12'.

Referring now to FIGS. 9–12 there is shown a third embodiment of the invention wherein a package 79 includes a paper board carton 82, a honeycomb core 84, a bottom honeycomb pad 85 and a pair of top honeycomb pads 86 and 87. The honeycomb core 84 includes an outer periphery 90 and a cruciform divider 92 which divides the core 84 into four compartments 93, 94, 95 and 96. The compartments 93–96 receive four 2.5 liter bottles 20".

As with the packaging arrangement of the first embodiment of FIGS. 1–4, the bottom pad 85 is beneath the honeycomb core 84 while two pads 86 and 87 are disposed on top of the honeycomb core 84. As with the first and second embodiments of FIGS. 1–4 and 5–8, the height of the honeycomb core 84 is equal to the height of the capped bottles 20" so that top panel 86 rests not only on the top end of the honeycomb core 84 but also on the top surfaces of the bottle caps 55". The same advantages as to rigidity are thus available in the third embodiment of FIGS. 9–12 as are available in the first and second embodiments of FIGS. 1–4 and 5–8, respectively. In addition, the corners 100 of the carton 82 provide the additional protection of crush zones 101 due to diagonal portions of the hexacomb core 84.

Figure 9A:
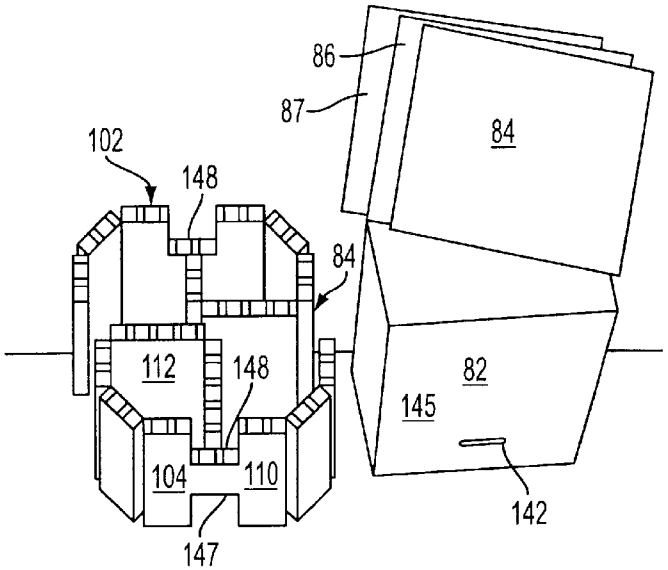
FIG. 9A is a third embodiment of a packaging kit in accordance with the present invention.
Figure 9B:
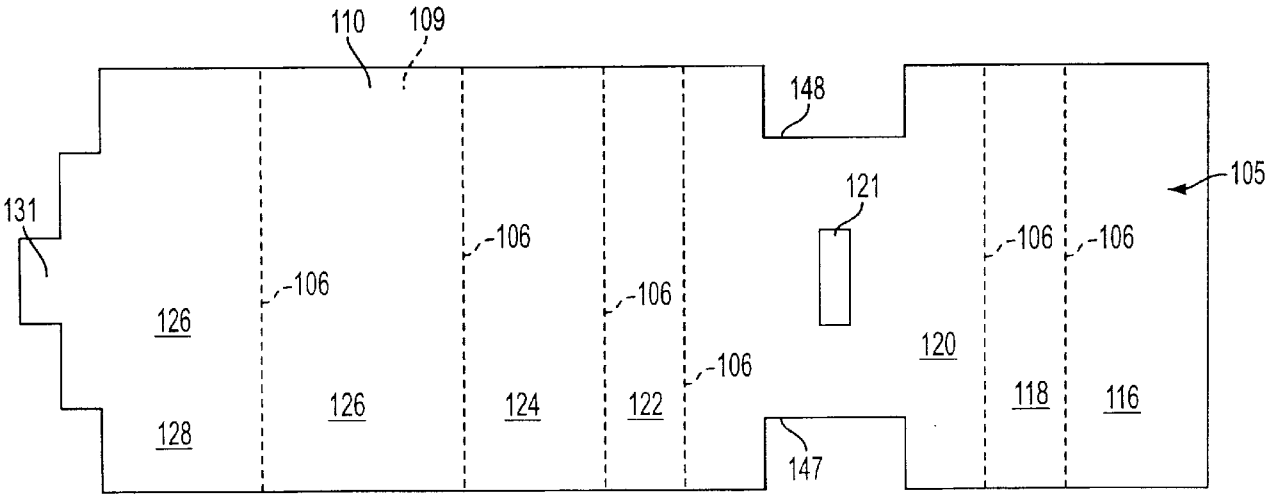
FIG. 9B is a planar view of a panel which is severed and folded to provide honeycomb packing for the packaging kit of FIG. 9.
Figure 10:
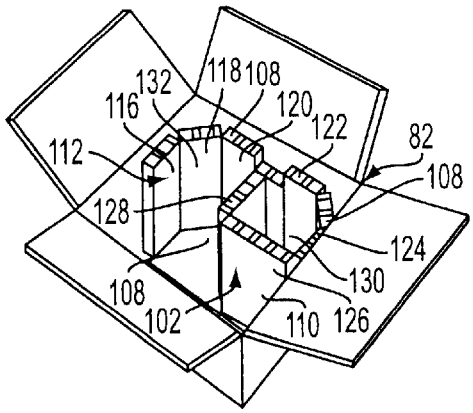
FIG. 10 is a top perspective view of the components of the kit of FIG. 9 partially assembled with one portion of the honeycomb packing inserted.

As is evident from FIGS. 9A and 9B, the honeycomb core 84 is comprised of two G-shaped core portions 102 and 104 which are reversed orientations of one another. The G-shaped core portions 102 and 104 are formed by severing two flat rectangular panels 105 (FIG. 9B) of honeycomb material, 1A at six locations 106 to provide a plurality of voids 108. The plurality of voids 108 are similar to the voids 46–49 of FIG. 1A in that they extend all the way through from the outwardly facing sheet 110 to an inwardly facing sheet 112.

Figure 11:
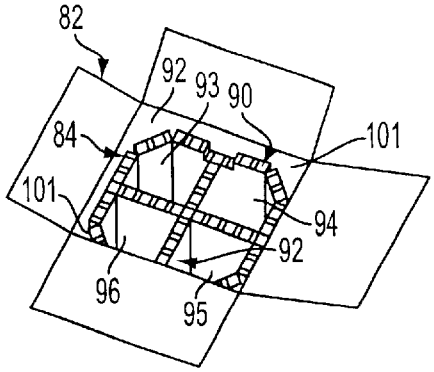
FIG. 11 is a top perspective view similar to FIG. 10 showing a second portion of the packing material of FIG. 9 inserted to form four compartments within the carton.
Figure 12:
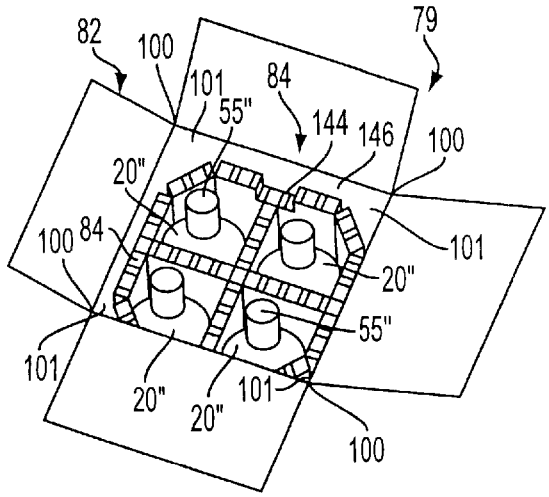
FIG. 12 is a view similar to FIG. 11 and showing four bottles in the four compartments of FIG. 11.
Figure 13A:
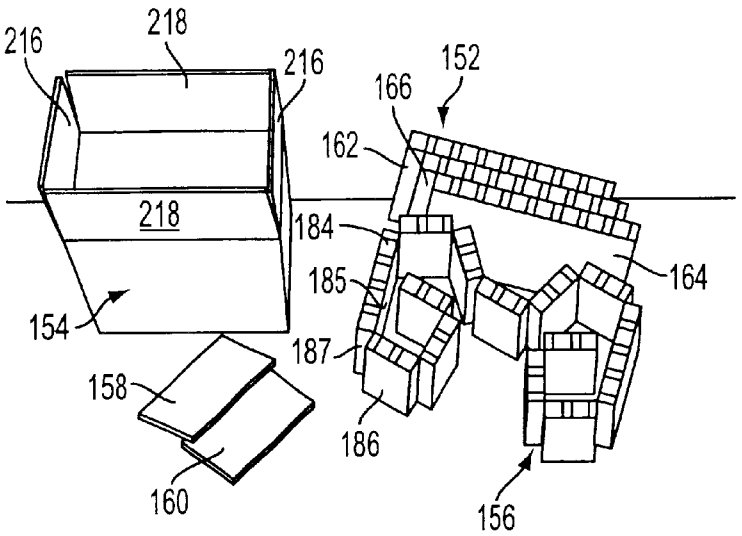
FIG. 13A is a perspective view of a packing kit in accordance with a fourth embodiment of the invention.
Figure 13B:
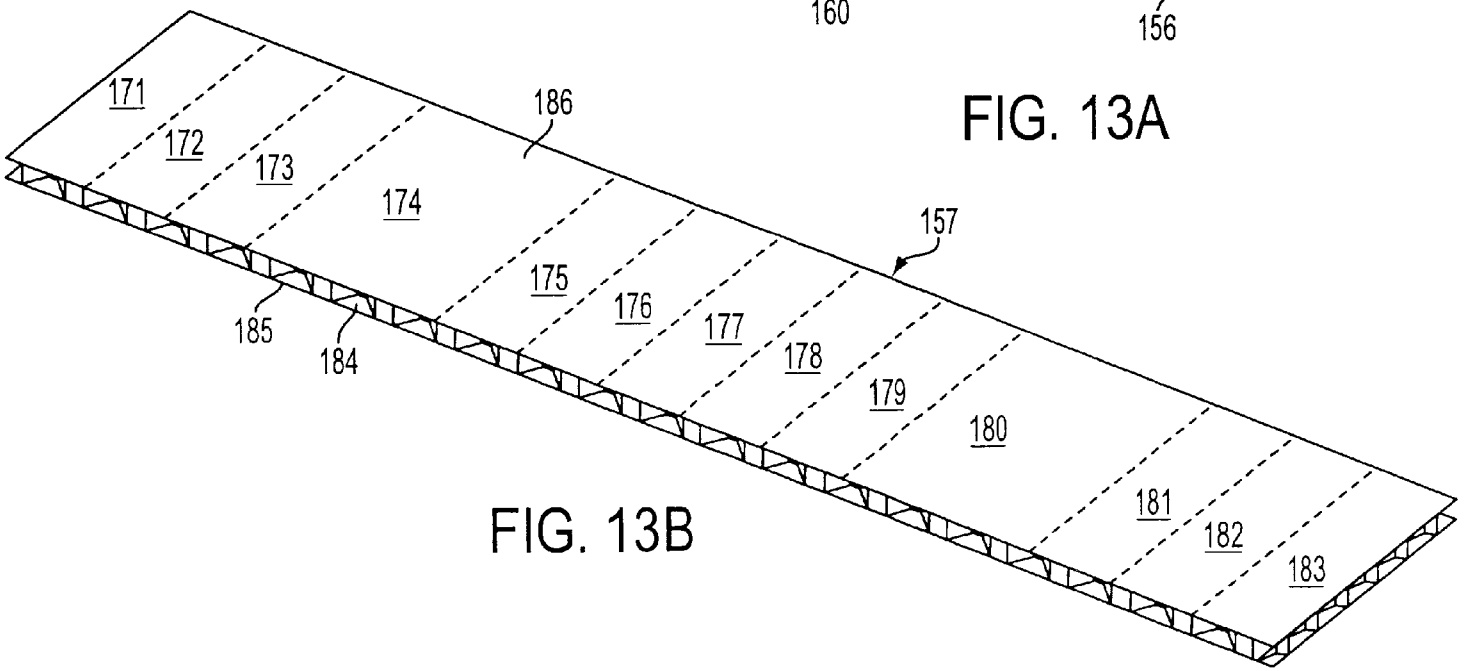
FIG. 13B is a planar view of a honeycomb panel which is severed and folded to provide honeycomb packing for the packaging kit of FIG. 13.

Referring further to the structure of the honeycomb sections 102 and 104, it is seen that each honeycomb portion has a base panel 116 that engages the inner surface of the carton 82 coextensively, which base panel 116 is joined by a diagonal panel 118 to a wide panel 120 with an aperture 121 therethrough. The wide panel 120 is joined by a second diagonal panel 122 to a relatively short panel 124 which is half as wide as the panel 120. Projecting perpendicular to the panel 124 is a transverse panel 126 and projecting perpendicular to the transverse panel 126 is a panel 128 that extends back and attaches to the panel 120 by inserting a tab 131 into the aperture 121 in the panel 120 (FIG. 9B). This arrangement provides a closed compartment 130 and an open compartment 132. As is suggested in FIG. 9A and is illustrated in FIG. 11, when the two partitions 102 and 104 of the honeycomb core 84 are placed together in the carton 82, the four closed compartments 93–96 completely surrounded by honeycomb material are provided, so that a square carton 82 can contain four bottles 20".

Preferably, the carton 82 has slots 142 and 144 located therein on opposite sides 145 and 146 thereof to facilitate lifting of the carton. The packing 102 has upper and lower cut outs 147 and 148 which align with the slots 142 and 144 to allow sufficient purchase for hand grips on the carton 82.

Referring now to FIGS. 13–16, a fourth embodiment of the invention comprises a package 150 configured from a kit 152 for containing six one liter bottles. It is seen from FIG. 13A that the kit 152 comprises a rectangular carton 154, a core 156 supplemented by a pair of side core panels 158 and 160, a bottom honeycomb pad 162 and two top honeycomb pads 164 and 166.

The package 150 is assembled by first inserting the bottom honeycomb pad 162 into carton 154 and then inserting the honeycomb core 156. The honeycomb core 156 is made of a single panel of honeycomb material 157 shown in FIG. 13B which is divided into thirteen honeycomb panel sections 171 to 183. In each of the panels 171–183 a honeycomb array 184 is sandwiched between a first cover sheet 185 and a second cover sheet 186, the first and second cover being selectively severed to allow folding of the single panel 157 into the plurality of panels 171–183.

Figure 14:
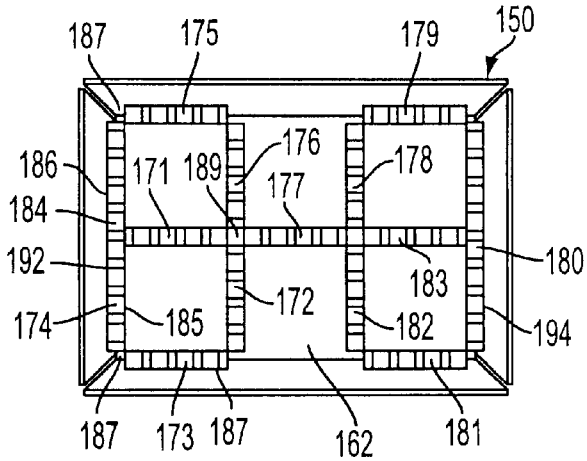
FIG. 14 is a top vie w showing a honeycomb core severed for folding inserted into a carton to form six compartments for receiving bottles.

As is seen in FIG. 14, the first panel 171 is connected along the first cover sheet 185 to panels 172 through 176 with the second cover sheet 186 being severed to form voids 187 which allow bending of the panel 157 while the panel sections are joined by the inner sheet 184. The panel section 176 is joined to the panel section 178 by the second cover sheet 186 which has a void 189 cut through to the inner sheet 185. Thereafter, the inner sheet 185 joins the panel section 178 to panel section 179 through panel section 183 by a void 187 cut through the second cover sheet 186. The two side honeycomb panels 174 and 180 have a length approximately twice as long as each of the panels 171–173 and 175–179 and 181–183 and abut the short sides 192 and 194 of the carton 154. As is apparent from FIGS. 14 and 15, the interior space 196 of the carton has now been divided into six compartments 201–206 which as is seen in FIG. 16 receives six bottles 20". The single honeycomb panel 157 has in FIG. 14 been folded into two figure 8-shaped sections separated by the single panel section 177.

EXAMPLES

Example 1

FIGS. 1–4

1. Erect and close bottom of carton using 3" wide kraft reinforced sealing tape;
2. Place one 5.25"×5.25"×0.75" pad into bottom of carton;
3. Fold 16.125"×8.875"×0.75" insert forming a square and place it into carton;
4. Place one 1 L bottle into the space provided by the carton insert;
5. Place two 5.25"×5.25"×0.75" pads on top; and
6. Secure carton closed using 3" wide kraft reinforced sealing tape.

Example 2

FIGS. 5–8

1. Erect and close bottom of carton using 3" wide kraft reinforced sealing tape;
2. Place two 7.5"×7.5"×0.75' pads into bottom of carton;
3. Fold one 21.0"×13.825"×0.75" insert forming a cylinder and place into carton;
4. Place one 4 L bottle into the space provided by the carton insert;
5. Place one fiber tube over the neck of the bottle with slot aligned with bottle handle;
6. Place one 7.5"×7.5"×0.75" pad on tope; and
7. Secure carton closed using 3" wide kraft reinforced sealing tape.

Example 3

FIGS. 9–12

1. Erect and close bottom of carton using 3" wide kraft reinforced sealing tape;
2. Place one 14.5"×14.125"×0.75" pad into bottom of carton;
3. Fold one 37.625"×13.5"×0.75" insert and place into carton as shown making sure die cut slots align with hand hole in carton;
4. Fold a second insert, and place into carton as shown forming 4 cells;
5. Place on 4L bottle into each cell;
6. Place two 14.5"×14.125"×0.75" pads on top; and
7. Secure carton closed using 3" wide kraft reinforced sealing tape.

Example 4

FIGS. 13–16

1. Erect and close bottom of carton using 3" wide kraft reinforced sealing tape;
2. Place one 12"×8.25"×0.75" pad into bottom or carton;
3. Fold one 46.625"×7.938"×0.75" insert as shown and place it into carton;

4. Place two 7.938"×4.5"×0.75" fill-in-pads, one in each void space, on the perimeter of the carton;
5. Place one 1 L bottle into each of the six void spaces formed by the insert and fill-in-pads; and
6. Place two 12"×8.25"×0.75" pads on top Secure carton closed using 3" wide kraft reinforced sealing tape.

Figure 15:
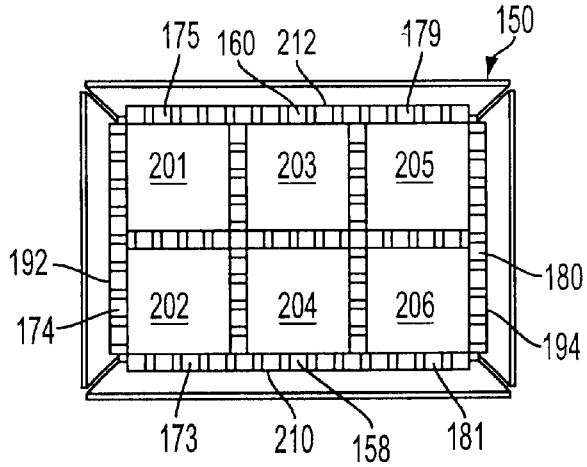
FIG. 15 is a top view similar to FIG. 14 showing the center compartment with additional honeycomb core panels inserted to complete the core.
Figure 16:
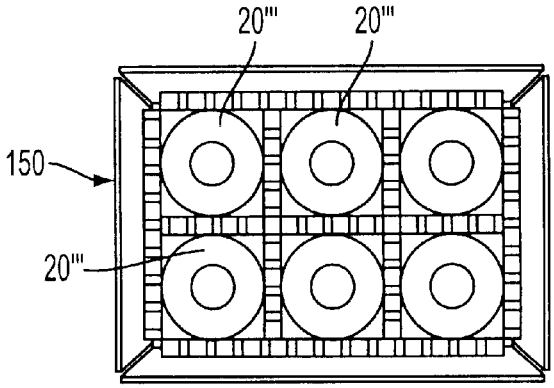
FIG. 16 is a top vie w similar to FIG. 15 showing six bottles inserted into the six compartments.

In order to surround the bottles 20''' in the compartments 201 and 206, the separate honeycomb panel sections 158 and 160 are inserted between the panel sections 173 and 181 on long side 210 of the carton 154 and between the panel sections 175 and 179 on the long side 212 of the carton (see FIG. 15).

Before placing the honeycomb core 156 in the carton 154, the bottom honeycomb pad 162 is placed in the carton so that the honeycomb core rests on the pad 162. The bottles 20''' are then placed in the compartments 201–206 so that their bottoms are protected by the honeycomb pad 162. Thereafter, the two panels 164 and 166 are placed on the upper end 214 of the core 156 so as to rest against both the upper end of the honeycomb core 156 and against the top surfaces of the bottle caps 55'''. This occurs because the height of the honeycomb core 156 is substantially equal to the height of the bottles 20''' with the caps 55''' screwed on. The inner flaps 216 of the carton 154 are then folded over the top pad 166 and outer flaps 218 of the carton folded over the inner flaps and taped shut. The resulting carton 150 is rigid and the bottles 20''' are cushioned by the honeycomb core 156 which is held in place by the rectangular carton 154.

From the foregoing description, one skilled in the art can easily ascertain the essential characteristics of this invention, and without departing form the spirit and scope thereof, can make various changes and modifications of the invention to adapt it to various usages and conditions.

What is claimed is:

1. Packaging for four bottles comprising:

a carton of square cross section having paper board panels defining a first space having a rectangular cross section and an axial length, the panels meeting to define four interior corners;

a paperboard honeycomb core having top and bottom ends disposed in the first space extending axially with respect to the axial length of the panels and being in abutment with the panels, the honeycomb core being comprised of two portions each defining a pair of compartments, each of which compartments is for receiving one bottle;

the honeycomb core having a first cover sheet facing inwardly of the packaging and defining a second space for receiving the bottles, said honeycomb core being severed through to the first cover sheet to define axially extending voids free of honeycomb material, and rectangular pads of honeycomb material positioned in the carton above and below the bottles and abutting the top and bottom ends of the honeycomb core whereby the bottles are surrounded by honeycomb material when the carton is closed over the rectangular pad above the bottles.

2. The packaging of claim 1 in combination with four bottles.

3. The packaging of claim 1 in combination with four glass bottle containing liquids of high purity.

4. The packaging of claim 1 in combination four glass bottles.

5. The packaging of claim 2 wherein one portion of the honeycomb core is a reverse image of the other.

6. The packaging of claim 5 in combination with four bottles.

7. The packaging of claim 5 in combination with four glass bottles containing liquids of high purity.

8. The packaging of claim 5 wherein each portion of the honeycomb core has five exterior honeycomb panels which face three walls of the carton and two exterior panels which extend across the space defined by the carton to partition the space into two compartments and wherein the first and second portions of the honeycomb panels cooperate to define four compartments for packaging four bottles within the carton.

9. The packaging of claim 8 wherein there are slots through the carton and cut outs in the exterior honeycomb panels, the cut outs being aligned with the slots to provide hand grips for the packaging.

10. The packaging of claim 9 in combination with four bottles.

11. The packaging of claim 9 in combination with four glass bottle containing liquids of high purity.

12. The packaging of claim 9 in combination with four glass bottles.

13. The packaging of claim 8 in combination with four bottles of liquid.

14. The packaging of claim 8 in combination with four glass bottles containing liquids of high purity.

15. The packaging of claim 8 in combination with four glass bottles.

* * * * *

UNITED STATES PATENT AND TRADEMARK OFFICE

CERTIFICATE OF CORRECTION

PATENT NO. : 6,536,654 B2
DATED : March 25, 2003
INVENTOR(S) : Reynolds et al.

It is certified that error appears in the above-identified patent and that said Letters Patent is hereby corrected as shown below:

Title page,
Item [75], Inventors, change "Los Angeles, CA (US)" to -- Yorba Linda, CA (US) --

Column 8,
Line 14, change "bottle" to -- bottles --;
Line 15, after "combination" insert -- with --;
Line 17, change "claim 2" to -- claim 1 --;
Line 39, change "bottle" to -- bottles --.

Signed and Sealed this

Fifth Day of April, 2005

JON W. DUDAS
*Director of the United States Patent and Trademark Office*